US006450467B2

(12) United States Patent
Timm

(10) Patent No.: US 6,450,467 B2
(45) Date of Patent: Sep. 17, 2002

(54) TILT ADJUSTABLE KEYBOARD SUPPORT

(75) Inventor: Derek Timm, Windsor, CA (US)

(73) Assignee: Work-Rite Ergonomic Accessories, Inc., Petaluma, CA (US)

( * ) Notice: Subject to any disclaimer, the term of this patent is extended or adjusted under 35 U.S.C. 154(b) by 0 days.

(21) Appl. No.: 09/902,430

(22) Filed: Jul. 10, 2001

Related U.S. Application Data

(63) Continuation-in-part of application No. 09/172,522, filed on Oct. 14, 1998.

(51) Int. Cl.[7] ..... E04G 3/00

(52) U.S. Cl. ..... 248/284.1; 248/430; 248/286.1; 248/291.1; 108/69; 108/75; 312/28; 384/49

(58) Field of Search ..... 248/429, 430, 248/284.1, 286.1, 291.1, 298.1, 281.11; 108/69, 75; 312/28; 384/49

(56) References Cited

U.S. PATENT DOCUMENTS

| | | | | |
|---|---|---|---|---|
| 4,616,798 A | | 10/1986 | Smeenge et al. | |
| 4,932,792 A | * | 6/1990 | Baxter | 384/18 |
| 4,991,981 A | * | 2/1991 | Baxter | 384/18 |
| 5,037,054 A | * | 8/1991 | Mcconnell | 248/284 |
| 5,145,136 A | * | 9/1992 | Mcconnell | 248/284 |
| 5,180,136 A | | 1/1993 | Sova | |
| 5,257,767 A | * | 11/1993 | Mcconnell | 248/284 |
| 5,292,097 A | | 3/1994 | Russell | |
| 5,839,373 A | * | 11/1998 | Lin | 108/140 |
| 5,881,984 A | * | 3/1999 | Lin | 248/284.1 |

FOREIGN PATENT DOCUMENTS

EP 0933045 * 4/1999

OTHER PUBLICATIONS

Work–Rite Ergonomic Accessories, Inc. Fall 1997 catalog.

* cited by examiner

*Primary Examiner*—Kimberly Wood
(74) *Attorney, Agent, or Firm*—Watts, Hoffmann, Fisher & Heinke, Co., LPA

(57) ABSTRACT

A keyboard supporting member has a generally planar keyboard support surface whose orientation is adjustable. A keyboard engaging member defines aligned incline defining slots on opposite sides of a center section. A second, workstation engaging member allows the user to move the keyboard back and forth with respect to a workstation. This allows the user to move the keyboard between a storage position and an in use position. A linkage interconnects the two members for adjusting a relative position of the keyboard engaging member with respect to the workstation engaging member thereby allowing the keyboard position and orientation to be controlled by the user. The linkage includes a first elongated member having one end rotatably mounted to the workstation engaging member which has an arcuate slot at one end spaced from the end that is connected to the workstation engaging member. The linkage also includes a second elongated member having one end rotatably mounted to the workstation engaging member and including a hole in an end spaced from the end that is connected to the workstation engaging member. A connector pass through the arcuate slot in the first elongated member, the aligned incline defining slots of the keyboard engaging member, the hole passing through the second elongated member, and wedge shaped blocks for adjusting frictional engagement between said first and second elongated members to maintain an orientation between the keyboard engaging member and the workstation.

28 Claims, 8 Drawing Sheets

TILT ADJUSTABLE KEYBOARD SUPPORT

CROSS REFERENCE TO RELATED APPLICATION

The present application is a continuation application of U.S. application Ser. No. 09/172,522, filed Oct. 14, 1998 and now suspended.

FIELD OF THE INVENTION

The present invention concerns a keyboard support for orienting a keyboard such as a computer keyboard with respect to a workstation surface.

BACKGROUND ART

The personal computer revolution has placed personal computers and computer terminals on corporate and home desktops throughout the world. Almost all such computers and terminals allow data entry through an alphanumeric keyboard. Often such a keyboard rests on a level desktop surface which is the same as the surface that supports the computer.

Especially when the user must work at the computer for long periods of time, it is important to be able to adjust the position and/or orientation of the keyboard. Built in tabs that form an integral part of the keyboard allow a limited amount of tilt adjustment. To allow more flexibility, however, the keyboard needs its own support.

Different types of keyboard supports are sold by Workrite Ergonomics Accessories Inc., assignee of the present invention. One such keyboard support is movably supported by a track that allows the keyboard to be retracted out from under a user's desk and then stored beneath the desk when the keyboard is not in use. This keyboard support also allows the user to adjust both the angle and the height of the keyboard in relation to its user. The tilt angles of the keyboard can be adjusted through a continuously variable angle of a total of 25 degrees from a negative tilt (front of keyboard elevated with respect to its back) of 15 degrees to a positive tilt (front of keyboard lower than its back) of 10 degrees. This commercially available keyboard is sold by Workrite under the model designation numbers 170, 171, 173, and 175.

Waterloo Furniture Components presently sells a support mechanism that includes a moveable linkage that couples a keyboard support to a desk. The keyboard support rides in a track support on progressive ball bearing slides that are oriented vertically, such that the ball bearings are disposed within planes generally perpendicular to the desk. A tab that extends from the track support housing is pressed by the user to retract and store the keyboard support. The height of the keyboard support is adjusted by rotating the keyboard support up and moving the keyboard support to the desired height and then releasing the keyboard support. The height of the keyboard support is maintained by a braking system made up of two wedge shaped blocks and two bolt holding the blocks within an inclined slot. The Waterloo linkage also includes a mechanism that allows a tilt angle to be varied over a range of about 6 degrees by loosening and then re-tightening a self locking nut. When the locking unit is loosened, a pin can be repositioned within a limited extent slot in a member that forms part of the linkage. This adjustment is made when the keyboard support is being fabricated and is not adjustable by the keyboard user.

SUMMARY OF THE INVENTION

One exemplary embodiment of the present invention concerns a keyboard support that allows a keyboard (typically a computer keyboard) to be moved and reoriented with respect to a workstation.

A keyboard supporting member has a generally planar keyboard support surface whose orientation is adjustable. A second, workstation engaging member allows the user to move the keyboard back and forth with respect to the workstation. The movement of the keyboard within the workstation engaging member may be accomplished on nylon slides or other suitable bearings. In an exemplary embodiment of the invention, progressive ball bearing slides oriented horizontally such that the ball bearings are disposed in a plane generally parallel to the workstation are located in the workstation engaging member to allow the user to move the keyboard to a storage position and then move the keyboard to an in use position. This horizontal orientation of the ball bearing slides provides a workstation engaging member having a lower profile than prior art devices. A latch mechanism prevents movement of the keyboard back to the storage position after the keyboard in extended to the in use position unless a lever is pressed. A linkage interconnects the two members for adjusting a relative position of the keyboard supporting member with respect to the workstation engaging member thereby allowing the keyboard position and orientation to be controlled by the user.

The linkage includes a bracket having one end rotatably connected to the workstation engaging member. The bracket extends away from the workstation engaging member at an angle that controls the height of the keyboard in relation to the work surface. The bracket defines a pair of arcuate slots at one end spaced from the end that is connected to the workstation engaging member. The keyboard engaging member defines a pair of fingers each having an arcuate slot located at either side of the planar support surface. A connector passes through the arcuate slots of the bracket, the arcuate slots of the keyboard engaging member, a preload spring, and two wedge shaped pressure applying blocks. The pressure applying blocks exert an inward force on the fingers of the keyboard engaging member which in turn are frictionally engaged with the bracket. The preload spring maintains engagement between the blocks and the arcuate slots. As the force from the pressure applying blocks increases so does the friction force between the bracket and keyboard engaging member, tending to prevent relative motion therebetween. The connector is used for increasing and decreasing a frictional engagement between the pressure applying blocks, the bracket and the keyboard engaging member. As the frictional engagement is increased or decreased by the connector, the wedge shaped pressure applying blocks are urged along an incline in the fingers of the keyboard engaging member and the user is able to adjust an orientation between the keyboard engaging member and the workstation over a continuous range of values. As a example of the exemplary embodiment, tilt angles over a range of 25 degrees can be chosen.

The keyboard engaging member may be manually rotated in a direction which releases the frictional engagement between the pressure applying blocks and the keyboard engaging member's inclined finger segments allowing free movement of the bracket relative to the workstation engaging member and the user may adjust the height of the keyboard engaging member relative to the workstation. When the bracket is released, the pressure applying blocks move back their original position prior to the manual rotation of the bracket thereby preserving the user's preferred orientation.

These and other advantages and features of the present invention will become better understood from a detailed description of an exemplary embodiment of the invention which is described in conjunction with the accompanying drawings.

DETAILED DESCRIPTION OF A PREFERRED EMBODIMENT OF THE INVENTION

Figure 1:
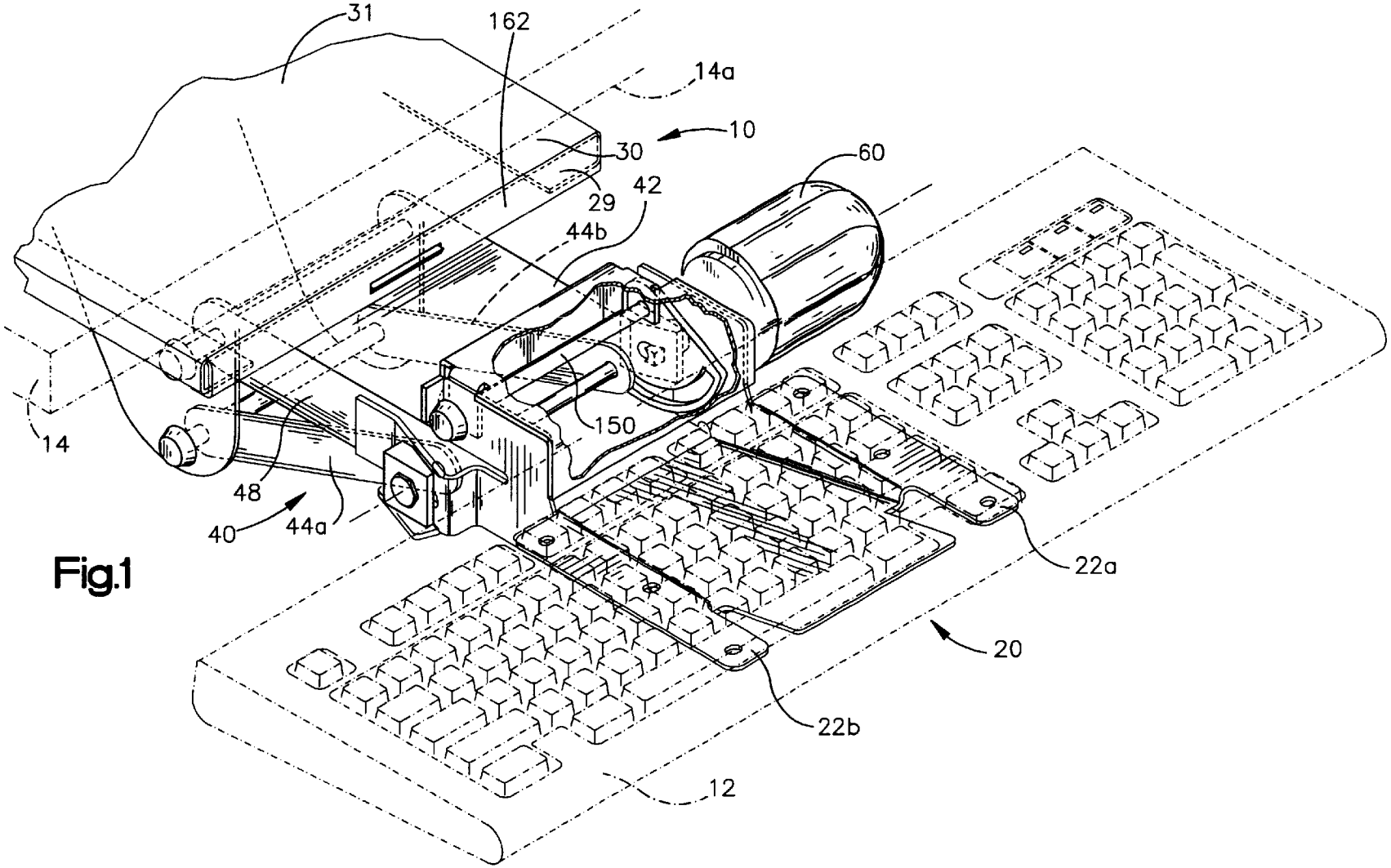
FIG. 1 is a perspective view of a keyboard support constructed in accordance with an exemplary embodiment of the present invention.
Figure 3:
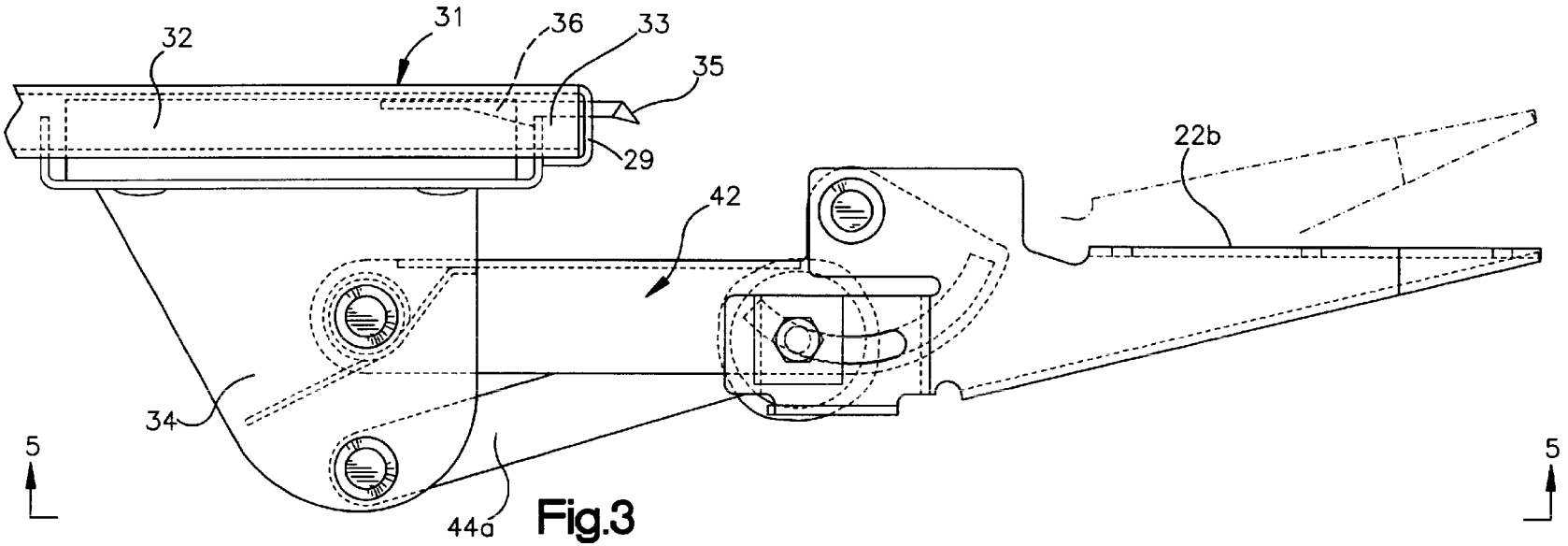
FIG. 3 is an elevation view of the keyboard support of FIGS. 1 and 2.
Figure 4:
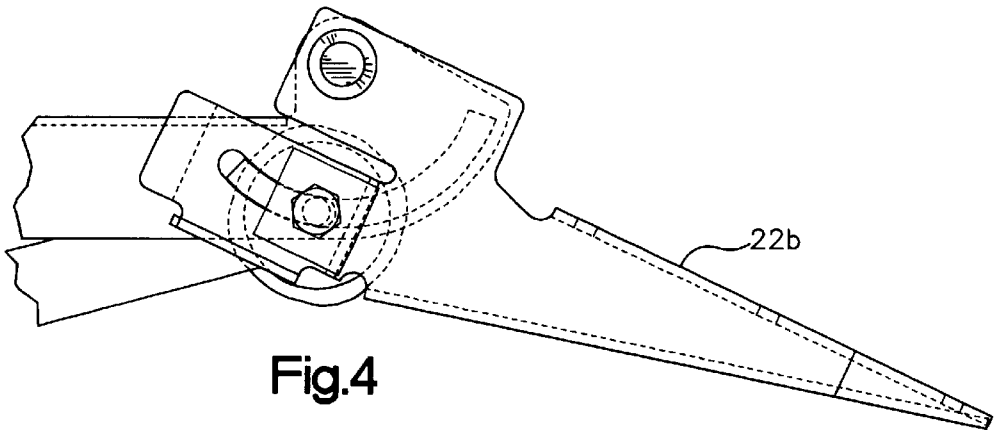
FIG. 4 is second segmented elevation view of the keyboard support wherein the keyboard contacting portion of the support has been rotated to a different orientation.

FIG. 1 depicts a keyboard support 10 constructed in accordance with one exemplary embodiment of the invention. The support 10 is intended to position a keyboard 12 with respect to a workstation such as a desk 14. A keyboard engaging member 20 has two spaced apart, generally planar keyboard support surfaces 22*a*, 22*b* that define a keyboard orientation relative to the desk 14. A workstation engaging member 30 in the form of an elongated metal housing has a top planar surface 31 that attaches to an undersurface of the desk 14 and supports the keyboard 12 for back and forth movement with respect to the desk 14. The workstation engaging member 30 attaches to a flat undersurface 14*a* of the desk 14 by means of a plurality of fasteners (not shown). This allows the keyboard to be moved to a storage position beneath the flat level undersurface 14*a* of the desk 14. A linkage 40 interconnects the keyboard engaging member 20 and a carriage 32 (see FIG. 3) and adjusts a relative height and orientation of the keyboard 12 with respect to the desk 14. As described below the orientation is continuously adjustable over a range of about 25 degrees and, for example, two different orientations of the keyboard 12 are depicted in FIGS. 3 and 4. In FIG. 3 the keyboard engaging member 20 orients the keyboard generally horizontal with respect to the top surface 31 of the housing 30 that engages the desk 14 and in FIG. 4 the keyboard has a negative tilt.

Figure 10:
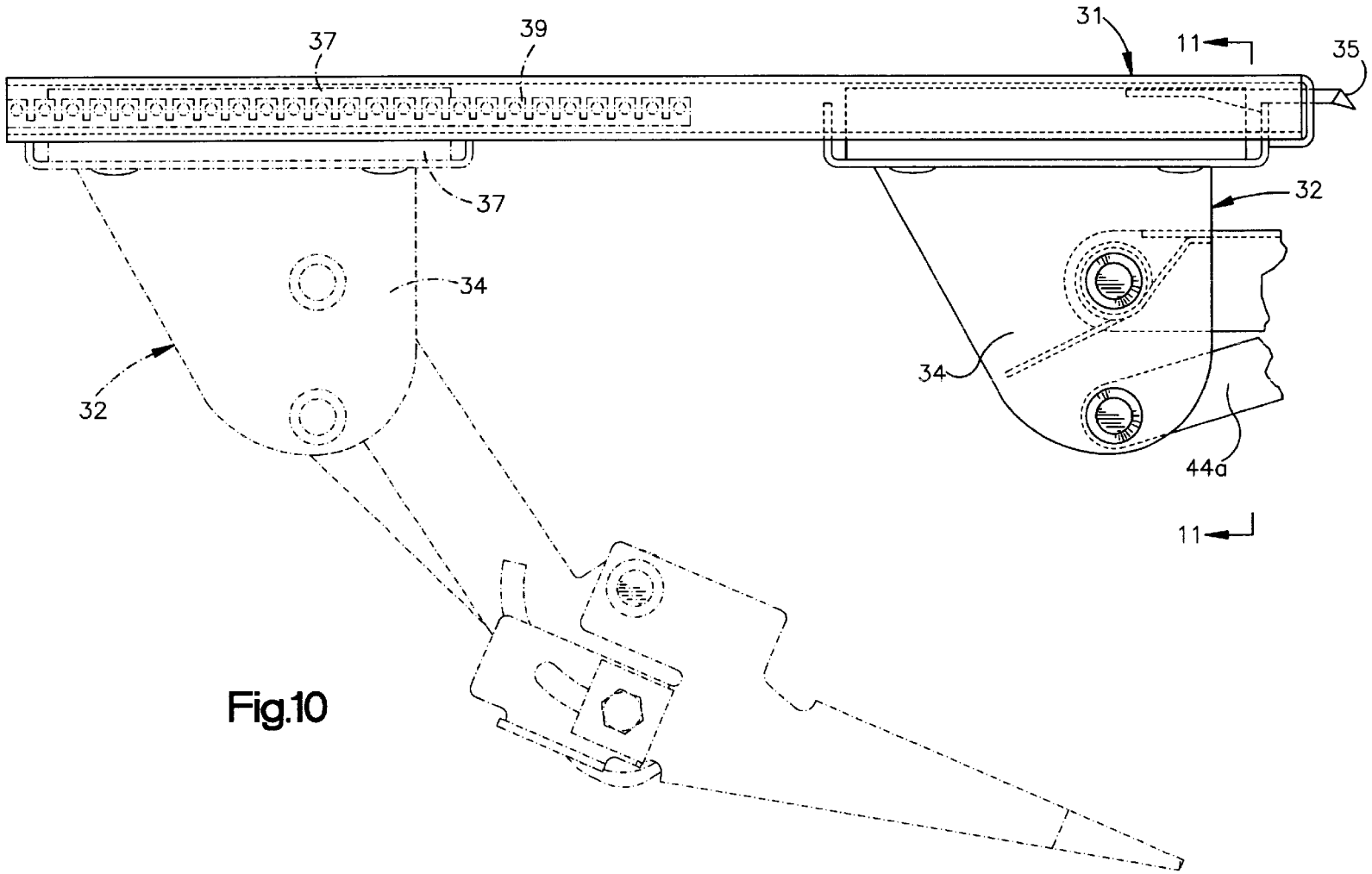
FIG. 10 is an enlarged side view of a workstation engaging member having a linear progressive ball bearing slide in a horizontal orientation shown in phantom line.

When an operator is seated at the desk 14, the keyboard 12 is moved out from under the desk to an in use position in front of the desk. The back and fourth movement of the keyboard is provided by progressive ball bearing slides 39 having bearings that movably support a carriage bracket 37 connected to the carriage 32 (FIGS. 10 and 11) for movement along a generally linear travel path within tracks 28 riveted to "U" shaped channels 29 (also shown in FIG. 1). The slides 39 may travel the length of the housing 30 and the carriage bracket 37 travels with the slides 39 along the length of the slides. The ball bearing slides 39 are oriented horizontally, with the ball bearings 39*a* disposed in a plane P generally parallel to a worksurface of the workstation 14 (shown in FIGS. 1 and 11). This allows the housing to have a relatively low profile. The carriage 32 has a forwardly extending lip 33 which interacts with a latch 36 to prevent movement of the carriage 32 to the storage position once the carriage has traveled to the fully extended position as shown in FIG. 3. Once the carriage 32 has been latched into place by the latch 36 the user must press down on a lever 35 to disengage the latch 36 from the lip 33 to slide the carriage 32 back to the storage position. The lever 35 protrudes through a face cover 162 in the housing 30 which defines a low profile rectangular surface having dimensions of approximately 9.25 by 0.75 inches. Two downwardly extending supports 34 (only one of which is visible in the drawings) are connected to the carriage 32 and move back and forth along the generally linear travel path with the carriage. In order to reduce the housing 30 dimensions, the progressive ball bearing slides 39 such as Waterloo part numbers 612060R2175 and 612060L2175 are oriented horizontally to permit the housing 30 to have a low profile.

Figure 2:
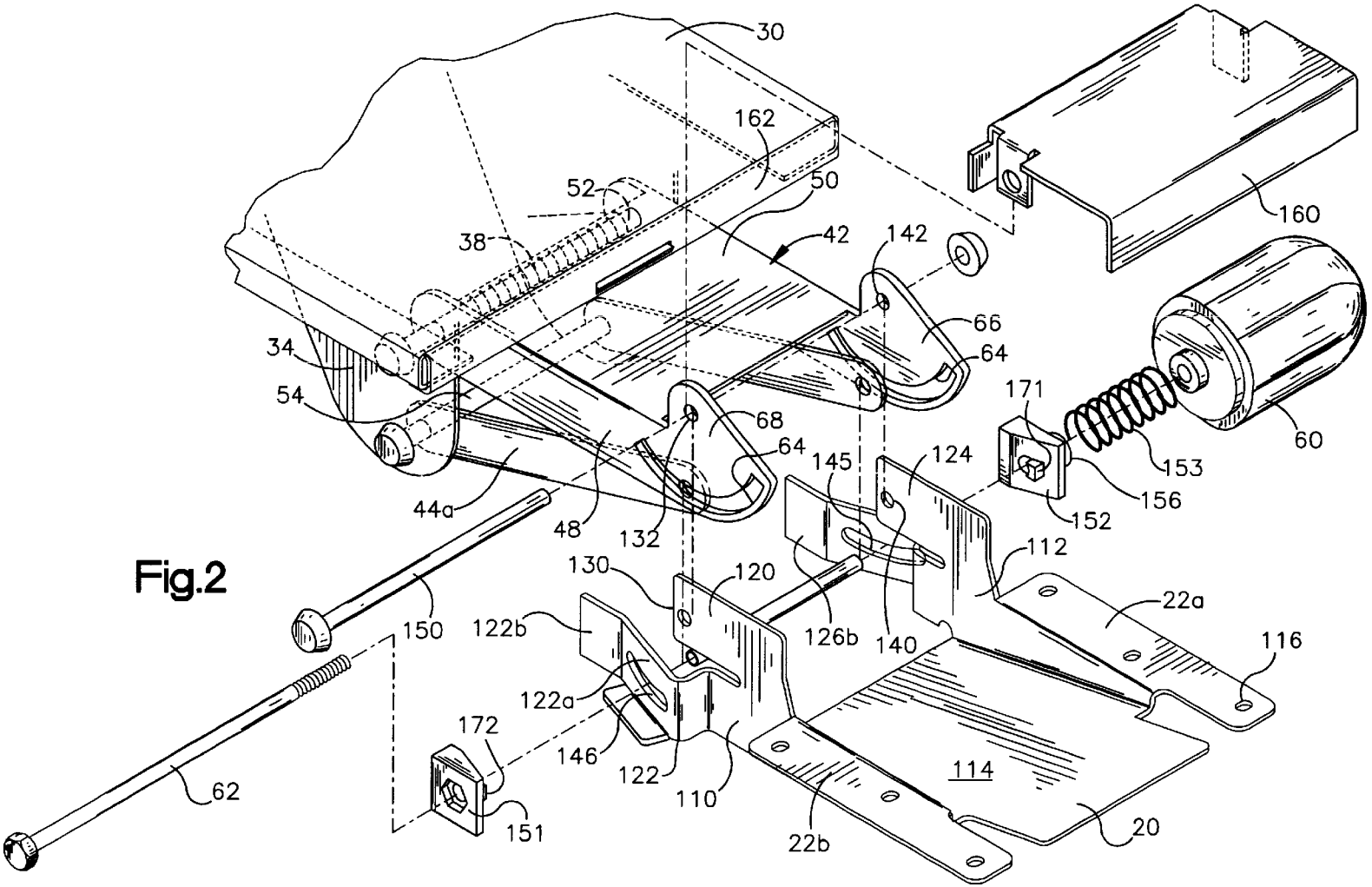
FIG. 2 is an exploded perspective view of the keyboard support depicted in FIG. 1.

With particular reference to FIG. 2, the linkage 40 includes a back bracket 42 and a pair of elongated arms 44*a*, 44*b* all supported by the downwardly extending supports 34. The bracket 42 has two downwardly extending sidewalls 46, 48 that are bridged by a generally planar center sheet 50. The sidewalls include openings that accommodate a bearing in the form of a rod 52 that is attached to the downwardly extending supports 34, and tabs 66, 68 and arcuate slots 64 spaced apart from the openings that accommodate the rod 52. The two elongated arms also define openings that accommodate a bearing in the form of a second rod 54 that is also attached to the downwardly extending supports 34. A counterbalance spring 38 is disposed around the rod 52 to assist the user in raising the keyboard support 10.

The keyboard engaging member, also referred to as the front bracket 20 is a metal stamping that is bent to form two generally parallel side pieces 110, 112 that extend from a center section 114. The keyboard support surfaces 22*a*, 22*b* are provided by bending a portion of the side pieces 110, 112 at right angles to form outwardly extending tabs having holes 116 extending through the tabs to accommodate connectors (not shown) for attaching the keyboard to the front bracket 20.

The side piece 110 of the front bracket stamping 20 also defines two fingers 120, 122 that define an engagement between the front bracket and the linkage 40. Similarly, an oppositely extending side piece 112 defines two fingers 124, 126 on an opposite side of the linkage 40 that define that engagement. The finger 120 is generally coplanar with the sidewall 110 and defines an opening 130 which aligns with an opening 132 in the tab 68 of the back bracket 42 when the front and back brackets are pivotally connected together. In an analogous fashion the finger 124 is generally coplanar with the sidewall 112 and defines an opening 140 which aligns with an opening 142 in the tab 66 of the back bracket 42 when the front and back brackets are pivotally connected together. A rod 150 extends through the respective openings 130, 132, 140, 142 to allow relatively unrestricted relative rotation between the front and back brackets 20, 42 about an axis coincident with the rod 150. The rod 150 also extends through a linkage cover assembly 160 which is disposed between fingers 120 and 124 to protect the linkage from debris and present an attractive appearance to the assembled keyboard support 10.

Figures 6, 7, 8, 9:
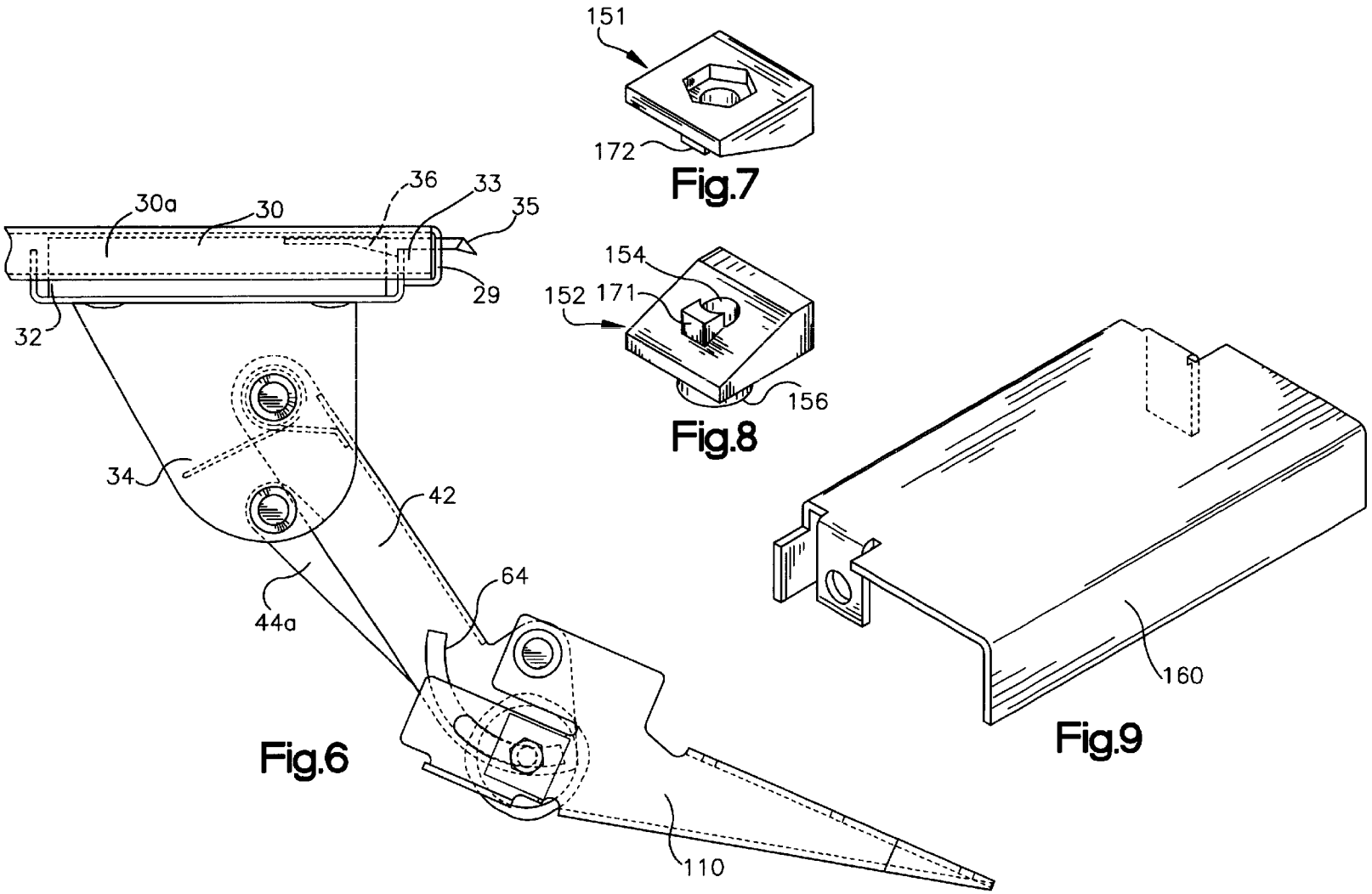
FIG. 6 is an elevation view of the keyboard support wherein the user has lowered the height of the keyboard with respect to a work surface but maintained an orientation with respect to the horizontal the same as the depiction in FIG. 4.
FIGS. 7 and 8 are perspective views of two pressure applying blocks used with an exemplary embodiment of the present invention.
FIG. 9 is a perspective view of a linkage cover assembly.

As seen by reference to FIGS. 3 and 6 the angle between the bracket 42 and the two supports 34 determine the height of the keyboard in relation to the desk. The angle between the bracket 42 and the two supports 34 is in turn determined by the position of threaded rod 62 along the arcuate slots 64. As depicted in FIG. 3, the bracket 42 extends away from the desk in a direction generally parallel to the desk top or work surface 14*a*. This corresponds to a maximum keyboard height adjustment for the support 10. Turning to FIG. 6, one sees the bracket 42 forms an angle with respect to the horizontal of about 60 degrees. This is accomplished by rotating the bracket downward away from the orientation shown in FIG. 3.

Figure 5:
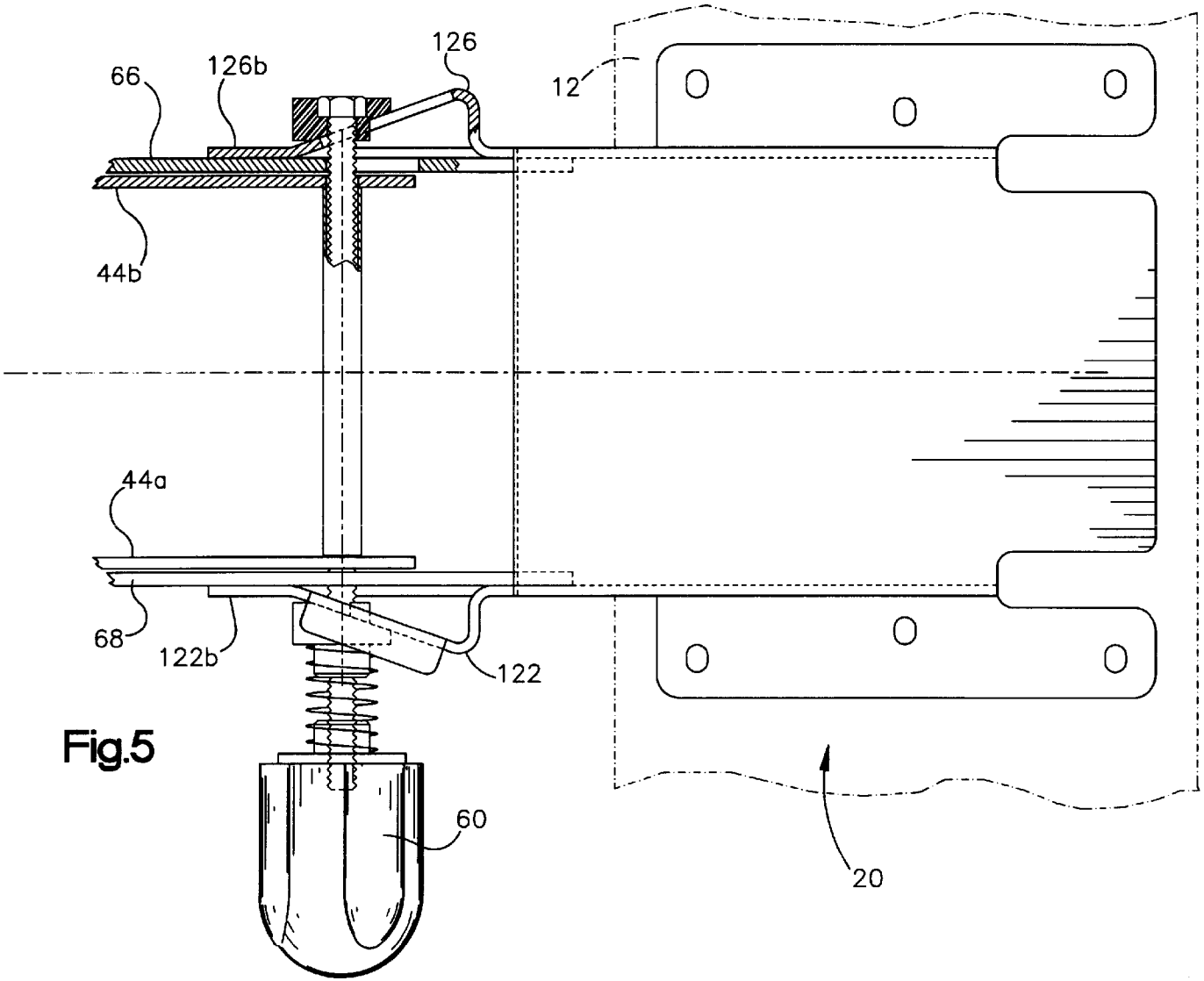
FIG. 5 is a bottom plan view, partially in section of the keyboard support depicted in FIGS. 1 and 2.

The bottom plan view of FIG. 5 depicts details of the frictional engagement that secures the front bracket 20 in a particular orientation and height. The two fingers 122, 126 bend away from their respective side walls 110, 112 at generally right angles and then back along incline defining segments 122*a*, 126*a* toward the plane of the sidewalls 110, 112. Where the incline defining segments 122*a*, 126*a* of the two fingers reach the plane of the sidewalls 110, 112 they are again bent to form segments 122*b*, 126*b* that are generally coplanar with the side walls 110, 112. When the support 10 is assembled inwardly facing surfaces of these segments 122*b*, 126*b* frictionally engage tabs 68, 66 of back bracket 42.

The incline defining segments 122*a*, 126*a* of the fingers 122, 126 define two arcuate slots 145, 146 which accommodate passage of the threaded rod 62 to which a knob 60 attaches and which allow the orientation of the keyboard to be adjusted through a range of twenty-five degrees or the extent of the arc of the two slots 140, 142. Two blocks or wedges 150, 152 (FIGS. 7 and 8) having openings 154, 156 passing through their bodies, and slides 171, 172 are pressed into the arcuate slots 145, 146 that extend through the angled segments 122*a*, 126*a* of the fingers 122, 126. A spring engaging block 152 (located on the right in FIG. 2) has an integral bearing 156 around which a preload spring 153 may rotate. The slides 171, 172 engage the arcuate slots 145, 146 and ride within them. The preload spring 153 exerts an inward force on the blocks 150, 152 to retain the slides 171, 172 within their respective channels or slots 145, 146 as the keyboard orientation is adjusted. As seen in FIG. 5, the finger segments 122*b*, 126*b* press against outer surfaces of the two tabs 66, 68 of the back bracket 42 along the region of the arcuate slots 64. The blocks 150, 152 exert pressure against the inclined segments 122*a*, 126*a* of the fingers 122, 126 which in turn exerts pressure of engagement between the segments finger segments 122*b*, 126*b* against the two tabs 66, 68 of the bracket 42.

A downward pressure on the keyboard engaging member 20 (tending to rotate the number 20 in a clockwise direction as seen in FIG. 3) urges the blocks 151, 152 apart and tends to move them along the inclined arcuate slots 145, 146 toward the keyboard support center section 114. This also increases the pressure, and hence frictional resistance, between the finger segments 122*b*, 126*b* and the tabs 66, 68 due to the interaction between the wedge shaped blocks 151, 152 and the incline defining segments 122*a*, 126*a*. The increased friction locks the relative position of the finger segments 122*a*, 126*a* and the tabs 66, 68 which prevents movement of the rod 62 along the arcuate slots 64 thereby providing a self locking feature which prevents unintended downward motion of the keyboard support.

To adjust the height of the keyboard support, the user rotates the keyboard engaging member 20 in an upward direction (counterclockwise in FIG. 3). This movement urges the blocks 151, 152 to move along the arcuate slots 145, 146 in a direction away from the center section 114. Due to the interaction between the blocks 151, 152 and the inclined finger segments 145, 146, this motion decreases the pressure, and hence the frictional resistance, between the inclined finger segments 122*a*, 126*a* and tabs 66, 68 which allows the rod 62 to travel within the arcuate slot 64 and thereby allows the height of the keyboard support to be adjusted. The preload spring 153 maintains the slides 171, 172 in the slots while pressure on them is released. When the user releases the keyboard engaging member 20, the blocks 151, 152 return to their original position providing friction to prevent further movement of the rod 62 within arcuate slots 64, locking the height of the keyboard support.

The adjusting knob 60 allows the user to control the orientation of the keyboard. The knob 60 threadingly engages the elongated rod 62 and traps the spring 153 between the knob 60 and the block 152. By rotating the knob 60 the user can apply or release pressure on the pressure applying blocks 151, 152 as the knob 60 is rotated. Applying pressure by rotating the knob 60 in a direction which tends to shorten the distance between the two pressure applying blocks 151, 152 urges the blocks to move down along the inclined segments 122*a*, 126*a* resulting in a positive angular change in keyboard orientation. Rotating the knob in the opposite direction decreases pressure on the pressure applying blocks causing them to move up the inclined segments 122*a*, 126*a* producing a negative angular change in keyboard orientation.

A force in a downward direction on the keyboard engaging member 20 (clockwise in FIG. 2) applies a torque about the rod 150 along a lever arm defined by the pivot of the rod 150 and the slides 171, 172 of the blocks 151, 152. This torque tends to produce a clockwise motion of the keyboard engaging member 20. However, as the keyboard engaging member is urged clockwise, the blocks 151, 152 are urged up the inclined fingers 122*a*, 126*a* and since the distance between the blocks 151, 152 has not changed, the pressure between the blocks 151, 152 and the fingers 122, 126 is increased due to the interaction between the wedge shaped blocks 151, 152 and the incline of the segments 122*a*, 126*a*. As this pressure increases, the friction force between the blocks 151, 152 prevents movement of the keyboard engaging member 20 about the rod 150. In addition, the increased pressure between the blocks 151, 152 and the fingers 122, 126 also tends to squeeze against the tabs 66, 68 increasing the friction force between the fingers 122, 126 and the tabs 66, 68 to prevent motion of the linkage 140 about the rod 150. Therefore, due to the self locking feature of the keyboard support, a downward force on the keyboard engaging member 20 will not cause motion of the keyboard support.

Figure 11:
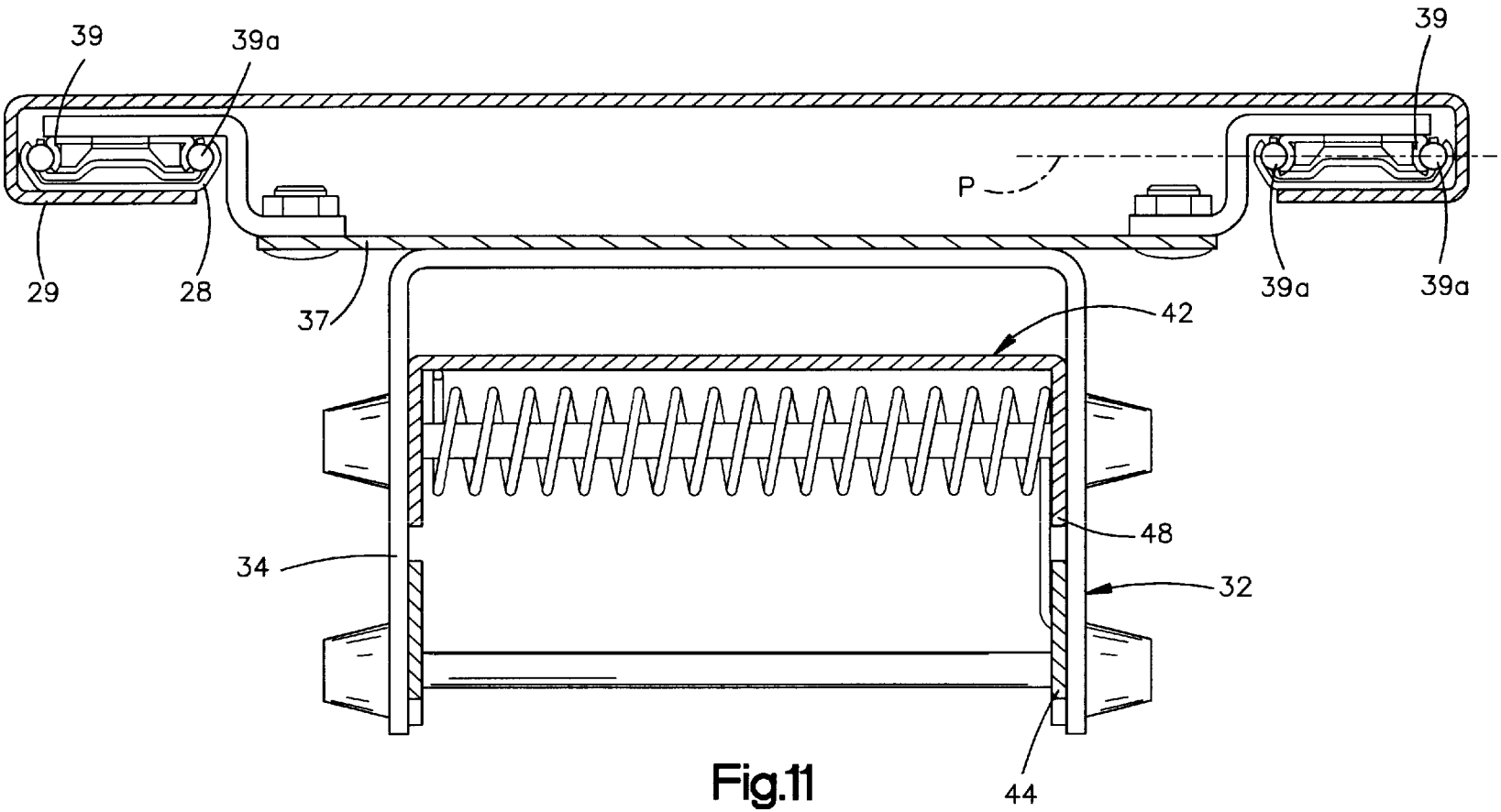
FIG. 11 is a front view of the workstation engaging member shown in FIG. 10.
Figure 12:
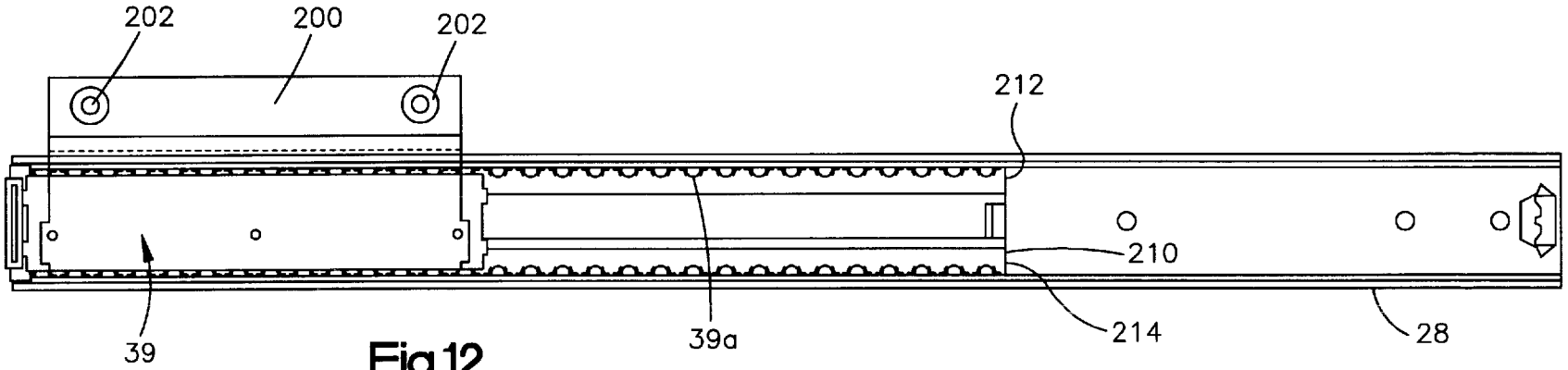
FIG. 12 is a top plan view of a track for the progressive linear ball bearing slide.
Figure 14:
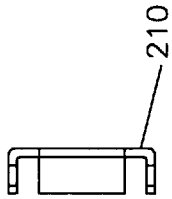
FIG. 14 is a viewe of the retainer as seen from the plane 14—14 in FIG. 13.
Figure 13:
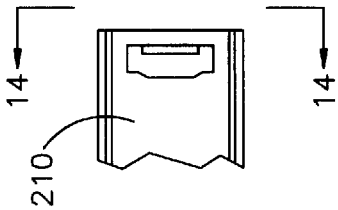
FIG. 13 is a top plan view of a ball bearing retainer.

Turning now to FIGS. 12–14, details of one of the two linear slides are depicted. Each slide 39 supports a bracket 200 that is attached to the carriage bracket 37 by means of suitable connectors 202. A ball bearing retainer 210 has opposite bearing retainer cages that extend along either side of the retainer for supporting the balls thereby forming a spaced apart ball bearing arrays 212, 214 for movement back and forth as the user slides the keyboard out from under the workstations. Further details of the slide may be obtained by reference to the Waterloo slide whose part numbers are reference above. As seen in the depiction of FIG. 11, orientation of the slides 39 within the housing 30 results in a low profile housing having a height of no more than 0.75 inches. This is an improvement over the prior art structures which tended to come into contact with the keyboard as the keyboard was pushed into its storage position beneath the work surface.

It is appreciated that while a preferred embodiment of the invention has been described, it is the intent that the invention include all modifications and alterations from the disclosed design falling within the spirit or scope of the appended claims.

I claim:

1. Apparatus for movably supporting a keyboard with respect to a workstation comprising:

a) a keyboard support member having a generally planar keyboard support surface whose orientation is controlled to control an orientation of the keyboard with respect to a work surface of said workstation; said keyboard support member comprising two side pieces spaced apart by a center section, said side pieces defining aligned slots on opposite sides of the center section;

b) a workstation engaging member that supports the keyboard for back and forth movement with respect to the workstation to allow the keyboard to be stored in a storage position and be moved to an in use position;

c) a linkage for adjusting a relative position of the keyboard engaging member with respect to the workstation engaging member; and d) wherein said workstation engaging member comprises:

i) a housing supporting a track defining a generally linear travel path;

ii) a ball bearing slide movable along the track, said ball bearing slide comprising ball bearings, the ball bearing slide being oriented such that the ball bearings are disposed within a plane generally parallel to a work surface of the workstation;

iii) a keyboard support carriage supported by the ball bearing slide for movement along the track.

2. The apparatus of claim 1 wherein the housing supports two spaced apart linearly extending tracks wherein each of said tracks includes first and second spaced apart wall surfaces that bound respective first and second ball bearing slides.

3. The apparatus of claim 2 wherein each of the first and second ball bearing slides includes first and second arrays ball bearings trapped at spaced locations along the slide for rolling engagement with the wall surfaces of its respective track.

4. The apparatus of claim 1 wherein the linkage comprises first and second linkage arms pivotally supported at spaced apart locations so that the first and second linkage arms pivot independently from each other during height and orientation adjustment of the keyboard with respect to the workstation.

5. Apparatus for movably supporting a keyboard with respect to a workstation comprising:

a) a keyboard engaging member having a generally planar keyboard support surface whose orientation is controlled to control an orientation of the keyboard with respect to a work surface of said workstation; said keyboard engaging member comprising two parallel side pieces spaced apart by a center section, said side pieces defining aligned slots on opposite sides of the center section;

b) a workstation engaging member that supports the keyboard for back and forth movement with respect to the workstation to allow the keyboard to be stored in a storage position and be moved to an in use position; and c) a linkage for adjusting a relative position of the keyboard engaging member with respect to the workstation engaging member, the linkage comprising:

i) an arcuate slot at an end spaced from the end that is mounted to the workstation engaging member;

ii) a connector passing through said arcuate slot and said aligned slots of said keyboard engaging member;

iii) a wedge carried by the connector; and iv) a knob connected to the connector to adjust the pressure on the wedge to adjust the orientation of the keyboard member by moving the connector within the arcuate slot; and d) wherein said workstation engaging member comprises:

i) at least one horizontally oriented track in which said linkage may ride;

ii) a horizontally oriented ball bearing slide movable along the length of the track comprising ball bearings, the ball bearing slide being oriented such that the ball bearings are disposed in a plane generally parallel to a work surface of the workstation;

iii) a keyboard support carriage supported by the ball bearing slide and movable along the slide.

6. Apparatus for movably supporting a keyboard with respect to a workstation comprising:

a) a keyboard support member having a generally planar keyboard support surface whose orientation is controlled to control an orientation of the keyboard with respect to a work surface of said workstation; said keyboard support member comprising two side pieces spaced apart by a center section, said side pieces defining aligned slots on opposite sides of the center section;

b) a workstation engaging member that supports the keyboard for back and forth movement with respect to the workstation to allow the keyboard to be stored in a storage position and be moved to an in use position;

c) a linkage for adjusting a relative position of the keyboard engaging member with respect to the workstation engaging member; and wherein said workstation engaging member comprises:

i) a housing supporting a track defining a generally linear travel path;

ii) a ball bearing slide movable along the track, said ball bearing slide comprising a ball bearing retainer for supporting spaced apart first and second arrays of ball bearings along opposite sides of the ball bearing retainer, the first and second arrays of ball bearings being disposed within a plane generally parallel to a work surface of the workstation; and iii) a keyboard support carriage supported by the ball bearing slide for movement along the track.

7. The apparatus of claim 6 wherein the housing supports two spaced apart linearly extending tracks wherein each of said tracks includes first and second spaced apart wall surfaces that bound respective first and second ball bearing slides.

8. The apparatus of claim 7 wherein each of the first and second ball bearing slides includes first and second arrays of ball bearings trapped at spaced locations along the slide for rolling engagement with the wall surfaces of its respective track.

9. The apparatus of claim 6 wherein the linkage comprises first and second linkage arms pivotally supported at spaced apart locations so that the first and second linkage arms pivot independently from each other during height and orientation adjustment of the keyboard with respect to the workstation.

10. The apparatus of claim 1 additionally including a carriage bracket coupled to the keyboard support carriage, the carriage bracket being supported by and moveable with respect to the ball bearing slide.

11. The apparatus of claim 10 wherein the carriage bracket slides along a path of travel with respect the ball bearing slide, the carriage bracket sliding on the ball bearings of the ball bearing slide.

12. The apparatus of claim 3 wherein the workstation engaging member additionally includes a carriage bracket coupled to the keyboard support carriage and the carriage bracket is supported by the first and second ball bearing slides and slides on the arrays of ball bearings of the first and second ball bearing slides.

13. The apparatus of claim 5 additionally including a carriage bracket coupled to the keyboard support carriage, the carriage bracket being supported by and moveable with respect to the ball bearing slide.

14. The apparatus of claim 13 wherein the carriage bracket slides along a path of travel with respect the ball bearing slide, the carriage bracket sliding on the ball bearings of the ball bearing slide.

15. The apparatus of claim 5 wherein the workstation engaging member includes two spaced apart linearly extending racks wherein each of said tracks includes first and second spaced apart wall surfaces that bound respective first and second ball bearing slides.

16. The apparatus of claim 15 wherein each of the first and second ball bearing slides includes first and second arrays of ball bearings trapped at spaced locations along the slide for rolling engagement with the wall surfaces of its track.

17. The apparatus of claim 5 wherein the linkage comprises first and second linkage arms pivotally supported at spaced apart locations so that the first and second linkage arms pivot independently from each other during height and orientation adjustment of the keyboard with respect to the workstation.

18. The apparatus of claim 16 wherein the workstation engaging member additionally includes a carriage bracket coupled to the keyboard support carriage and the carriage bracket is supported by the first and second ball bearing slides and slides on the arrays of ball bearings of the first and second ball bearing slides.

19. The apparatus of claim 6 additionally including a carriage bracket coupled to the keyboard support carriage, the carriage bracket being supported by and moveable with respect to the ball bearing slide.

20. The apparatus of claim 19 wherein the carriage bracket slides along a path of travel with respect the ball bearing slide, the carriage bracket sliding on the ball bearings of the ball bearing slide.

21. The apparatus of claim 8 wherein the carriage bracket is supported by the first and second ball bearing slides and slides on the arrays of ball bearings of the first and second ball bearing slides.

22. Apparatus for movably supporting a keyboard with respect to a workstation comprising:

a) a keyboard support member having a generally planar keyboard support surface whose orientation is controlled to control an orientation of the keyboard with respect to a work surface of the workstation;

b) a workstation engaging member that supports the keyboard for back and forth movement with respect to the workstation to allow the keyboard to be stored in a storage position and be moved to an in use position;

c) a linkage for adjusting a relative position of the keyboard engaging member with respect to the workstation engaging member; and wherein said workstation engaging member comprises:

i) a housing supporting a track defining a generally linear travel path;

ii) a ball bearing slide movable along the track, said ball bearing slide comprising a ball bearing retainer for supporting spaced apart first and second arrays of ball bearings, the first and second arrays of ball bearings being disposed within a plane generally parallel to a work surface of the workstation; and iii) a keyboard support carriage supported by the ball bearing slide for movement along the track.

23. The apparatus of claim 22 wherein the first and second arrays of ball bearings are supported along opposite sides of the ball bearing retainer.

24. The apparatus of claim 22 wherein the housing supports two spaced apart linearly extending tracks wherein each of said tracks includes first and second spaced apart wall surfaces that bound respective first and second ball bearing slides.

25. The apparatus of claim 24 wherein each of the first and second ball bearing slides includes first and second arrays of ball bearings trapped at spaced locations along the slide for rolling engagement with the wall surfaces of its respective track.

26. The apparatus of claim 22 wherein the keyboard support member includes two side pieces spaced apart by a center section, the side pieces defining aligned slots on opposite sides of the center section.

27. The apparatus of claim 22 wherein the linkage comprises first and second linkage arms pivotally supported at spaced apart locations so that the first and second linkage arms pivot independently from each other during height and orientation adjustment of the keyboard with respect to the workstation.

28. The apparatus of claim 22 additionally including a carriage bracket coupled to the keyboard support carriage, the carriage bracket being supported by and moveable with respect to the ball bearing slide.

* * * * *

UNITED STATES PATENT AND TRADEMARK OFFICE

CERTIFICATE OF CORRECTION

PATENT NO. : 6,450,467 B2
DATED : September 17, 2002
INVENTOR(S) : Derek Timm

It is certified that error appears in the above-identified patent and that said Letters Patent is hereby corrected as shown below:

Title page,
Item [63], Related U.S. Application Data should read:
-- [63] Continuation of application No. 09/172,522, filed on Oct. 14, 1998. --

Signed and Sealed this

Eighteenth Day of February, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,450,467 B2
DATED : September 17, 2002
INVENTOR(S) : Derek Timm

It is certified that error appears in the above-identified patent and that said Letters Patent is hereby corrected as shown below:

Column 7,
Line 31, change “keyboard engaging member” to -- keyboard support member --.

Column 8,
Line 44, change “keyboard engaging member” to -- keyboard support member --.

Column 10,
Line 15, change “keyboard engaging member” to -- keyboard support member --.

Signed and Sealed this

First Day of April, 2003

JAMES E. ROGAN
*Director of the United States Patent and Trademark Office*